US011120723B2

(12) United States Patent
Bang et al.

(10) Patent No.: US 11,120,723 B2
(45) Date of Patent: Sep. 14, 2021

(54) DISPLAY PANEL DRIVER AND DISPLAY DEVICE INCLUDING THE SAME

(71) Applicant: Samsung Display Co., Ltd., Yongin-si (KR)

(72) Inventors: Silyi Bang, Hwaseong-si (KR); Myung Bo Sim, Yesan-gun (KR); Won Bok Lee, Seongnam-si (KR); Shim Ho Yi, Seoul (KR); Jinhyuk Jang, Hwaseong-si (KR); Chan Sung Jung, Gwangmyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/714,193

(22) Filed: Dec. 13, 2019

(65) Prior Publication Data

US 2020/0193889 A1 Jun. 18, 2020

(30) Foreign Application Priority Data

Dec. 14, 2018 (KR) ..... 10-2018-0161746

(51) Int. Cl.
*G09G 3/20* (2006.01)

(52) U.S. Cl.
CPC ..... *G09G 3/20* (2013.01); *G09G 2310/08* (2013.01); *G09G 2370/00* (2013.01)

(58) Field of Classification Search
None
See application file for complete search history.

(56) References Cited

U.S. PATENT DOCUMENTS

2011/0292099 A1* 12/2011 Kim ..... G09G 3/3614 345/691
2012/0256890 A1* 10/2012 Araki ..... G02F 1/133308 345/204
2013/0207940 A1* 8/2013 Song ..... G09G 3/20 345/204

FOREIGN PATENT DOCUMENTS

KR 10-2018-0087910 A 8/2018

* cited by examiner

*Primary Examiner* — Ifedayo B Iluyomade
(74) *Attorney, Agent, or Firm* — Lewis Roca Rothgerber Christie LLP

(57) ABSTRACT

A display panel driver includes a storage unit configured to store an align pattern and a timing controller configured to output align image data based on an align control signal provided from a facility driver during a mechanism assembly process of a display panel. The align pattern includes an align mark, and the align image data includes the align pattern.

13 Claims, 8 Drawing Sheets

DISPLAY PANEL DRIVER AND DISPLAY DEVICE INCLUDING THE SAME

CROSS-REFERENCE TO RELATED APPLICATION

This application claims priority to and the benefit of Korean Patent Application No. 10-2018-0161746, filed on Dec. 14, 2018 in the Korean Intellectual Property Office (KIPO), the content of which is incorporated herein in its entirety by reference.

BACKGROUND

1. Field

Aspects of example embodiments relate generally to a display panel driver and a display device including the same.

2. Description of the Related Art

Flat panel display (FPD) devices are widely used as display devices of electronic devices because FPD devices are relatively lightweight and thin compared to, for example, cathode-ray tube (CRT) display devices. Examples of FPD devices include liquid crystal display (LCD) devices, field emission display (FED) devices, plasma display panel (PDP) devices, and organic light emitting display (OLED) devices.

In manufacturing a display device, a process of assembling a display panel and a mechanism (e.g., a housing or other component) by using an align mark (e.g., an alignment mark) formed in a non-display area of the display panel is generally used. The non-display area of display panels has, however, recently been reduced as display devices having narrow bezels are developed. Thus, a space for forming the align mark is reduced.

SUMMARY

Some example embodiments provide a display panel driver configured to facilitate a process of assembling a display panel and a mechanism.

Some example embodiments provide a display device configured to facilitate a process of assembling a display panel and a mechanism.

According to an embodiment, a display panel driver includes a storage unit configured to store an align pattern and a timing controller configured to output align image data based on an align control signal provided from a facility driver during a mechanism assembly process of a display panel. The align pattern includes an align mark, and the align image data includes the align pattern.

The align control signal may be a power signal.

The timing controller may be configured to be driven in a fail mode when the power signal is provided to the timing controller.

The timing controller may be configured to output fail image data in the fail mode, and the display panel may be configured to display an image based on the fail image data.

The timing controller may be configured to detect image data output from the timing controller and may be configured to output the align image data when the image data is the fail image data.

The align control signal may be an enable signal having a reference voltage level.

The timing controller may be configured to output the align image data when the enable signal is provided to the timing controller.

The align control signal may be a command signal provided to the timing controller by using I2C communication.

The timing controller may be configured to output the align image data when the command signal is provided to the timing controller.

According to an embodiment, a display device includes a display panel configured to display an image and a display panel driver configured to provide image data to the display panel. The display panel driver is configured to be coupled to a facility driver during a mechanism assembly process of the display panel and is configured to output align image data including an align pattern based on an align control signal provided from the facility driver.

The display panel driver may include a storage unit configured to store the align pattern and a timing controller configured to output the align image data based on the align control signal provided from the facility driver during the mechanism assembly process of the display panel. The align pattern may include an align mark.

The align control signal may be a power signal.

The timing controller may be configured to be driven in a fail mode when the power signal is provided to the timing controller.

The timing controller may be configured to output fail image data that displays an image on the display panel.

The timing controller may be configured to detect image data output from the timing controller and may be configured to output the align image data when the image data is the fail image data.

The align control signal may be an enable signal having a reference voltage level.

The timing controller may output the align image data when the enable signal is provided to the timing controller.

The align control signal may be a command signal provided to the timing controller by using I2C communication.

The timing controller may be configured to output the align image data when the command signal is provided to the timing controller.

The align pattern may include the align mark arranged on at a reference position.

Therefore, the display panel driver and the display device including the same may display the align pattern suitable for each of the display panel by outputting the align image data based on the align control signal provided from the facility driver during the mechanism assembly process of the display panel. Thus, the align mark may be arranged at the correct position and a recognition rate of the align mark may be improved.

Further, the facility may not need to change during manufacturing because each of the display panels displays the align image data during the mechanism assembly process of the display panel. Thus, tack-times may be reduced.

Therefore, the display panel driver and the display device including the same may facilitate the mechanism assembly process of the display panel.

BRIEF DESCRIPTION OF THE DRAWINGS

Illustrative, non-limiting example embodiments will be more clearly understood from the following detailed description, taken in conjunction with the accompanying drawings, in which.

DETAILED DESCRIPTION

Figure 1:
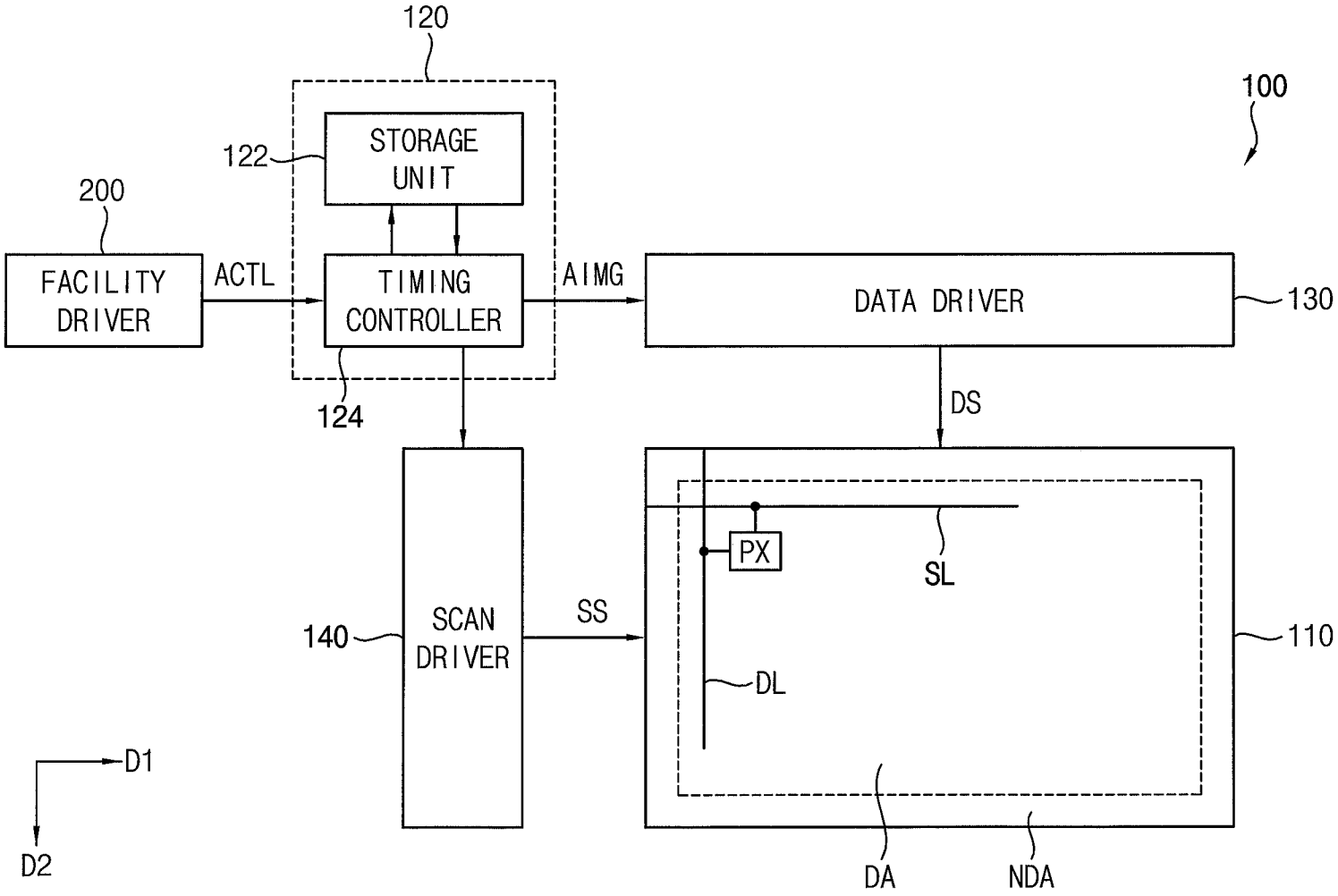
FIG. 1 is a block diagram illustrating a display device according to an example embodiment.

Hereinafter, aspects and features of the present inventive concept will be explained in detail with reference to the accompanying drawings. It will be understood that when an element or layer is referred to as being "on," "connected to," or "coupled to" another element or layer, it may be directly on, connected, or coupled to the other element or layer or one or more intervening elements or layers may also be present. When an element or layer is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements.

The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively. As used herein, the terms "substantially," "about," and similar terms are used as terms of approximation and not as terms of degree, and are intended to account for the inherent variations in measured or calculated values that would be recognized by those of ordinary skill in the art.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments. In the figures, dimensions of the various elements, layers, etc. may be exaggerated for clarity of illustration.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

Figure 2A:
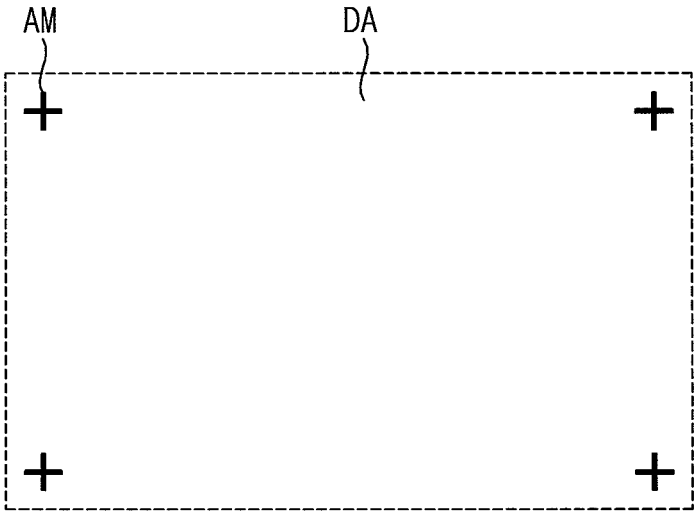
FIGS. 2A-2C are diagrams illustrating examples of align patterns stored in a storage unit included in the display device shown in FIG. 1.
Figure 2B:
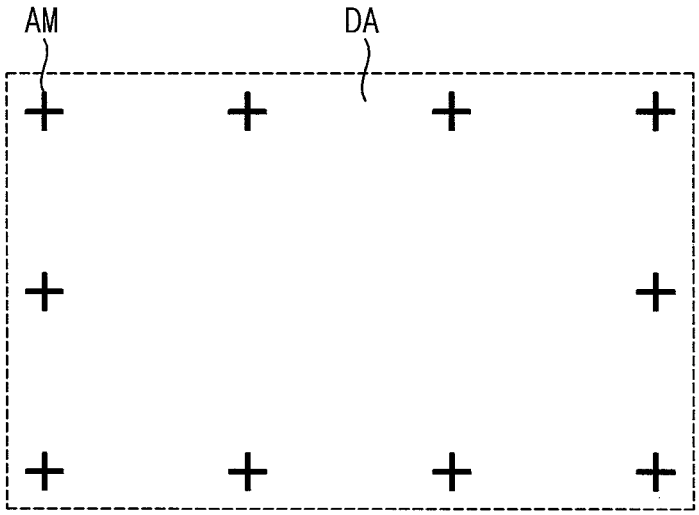
Figure 2C:
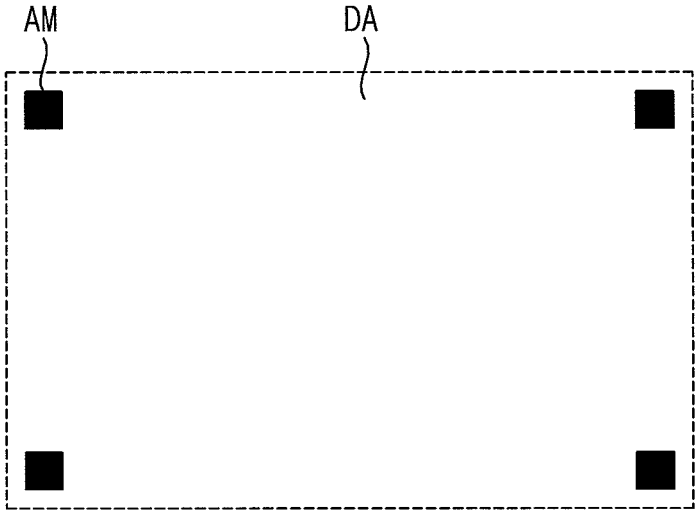

FIG. 1 is a block diagram illustrating a display device according to an example embodiment. FIGS. 2A-2C are diagrams illustrating examples of align patterns (e.g., alignment patterns) stored in a storage unit included in the display device shown in FIG. 1.

Referring to FIG. 1, a display device 100 may include a display panel 110, a display panel driver 120, a data driver 130, and a scan driver 140. The display panel driver 120 may be coupled to a facility driver 200 in (or during) a mechanism assembly process of the display panel 110.

The display panel 110 may include a plurality of pixels PX. A plurality of data lines DL and a plurality of scan lines SL may be formed in the display panel 110. The scan lines SL may extend in a first direction D1 and may be arranged adjacent each other in a second direction D2 perpendicular to the first direction D1. The data lines DL may extend in the second direction D2 and may be arranged adjacent each other in the first direction D1. The first direction D1 may be parallel with a long side of the display panel 110, and the second direction D2 may be parallel with a short side of the display panel 110. Each of the pixels PX may be formed at an intersection region of the data line DL and the scan line SL. In some example embodiments, each of the pixels PX may include a thin film transistor electrically coupled to the scan line SL and the data line DL, a storage capacitor coupled to the thin film transistor, a driving transistor coupled to the storage capacitor, and an organic light emitting diode coupled to the driving transistor. Thus, the display panel 110 may be an organic light emitting display panel, and the display device 100 may be an organic light emitting display device. In this embodiment, the display panel 110 may be assembled with a housing in (or during) the mechanism assembly process. In other example embodiments, each of the pixels PX may include a thin film transistor electrically coupled to the scan line SL and the data line DL, a liquid crystal capacitor, and a storage capacitor coupled to the thin film transistor. Thus, the display panel 110 may be a liquid crystal display panel, and the display device 100 may be a liquid crystal display device. In this embodiment, the display panel 110 may be assembled with a backlight unit during the mechanism assembly process.

The display panel 110 may have a display area DA and a non-display area NDA. The pixels PX may be formed in the display area DA, and an image may be displayed on the display area DA. Lines, circuits, etc. for driving the pixels PX may be formed in the non-display area NDA. An align mark (e.g., an alignment mark) for assembling the display panel 110 during the mechanism assembly may be formed in the non-display area NDA. Recently, however, the non-display area NDA of display panels has been reduced such that the display device 100 has a relatively narrow bezel. Thus, a space for forming the align mark is reduced. The display device 100 according to example embodiments may facilitate the mechanism assembly process of the display device 100 having the narrow bezel by displaying align image data (e.g., alignment image data) that includes an align mark on the display panel 110 based on a signal provided from (or provided by) the facility driver 200 during the mechanism assembly process of the display panel 110.

The display panel driver 120 may include a storage unit 122 and a timing controller 124. Each of the storage unit 122 and the timing controller 124 may be implemented as a chip and may be mounted on a printed circuit board (PCB), a flexible printed circuit board (FPCB), etc. The printed circuit board or the flexible printed circuit board on which the storage unit 122 and the timing controller 124 are mounted may be coupled to the display panel 110.

Referring to FIGS. 2A-2C, the storage unit 122 may store an align pattern that includes one or more align marks AM. Referring to FIG. 2A, the storage unit 122 may store an align pattern having plus- or cross-shaped (+) align marks AM at positions corresponding to four corners of the display area DA of the display panel 110. Referring to FIG. 2B, the storage unit 122 may store an align pattern having the plus- or cross-shaped align marks AM arranged at regular intervals around (e.g., around the periphery of) the display area DA of the display panel 110. Referring to FIG. 2C, the storage unit 122 may store an align pattern having square-shaped align marks AM at positions corresponding to four corners of the display area DA of the display panel 110. Although the align marks AM having the plus shape and the square shape are described in FIGS. 2A-2C, the shape and number of the align marks AM are not limited thereto. For example, the align mark AM may have a rectangular shape or a circular shape, and the align pattern may include one or more align marks AM. Further, although align patterns including align marks AM arranged at the four corners of the display area DA or around the display area DA are described in FIGS. 2A-2C, the arrangement of the align marks AM on the display area DA of the display panel 110 is not limited thereto. For example, the align marks AM may be arranged at any suitable position in the display area DA.

The timing controller 124 may output image data.

The timing controller 124 may receive input image data and an input control signal from an external device when the display device 100 is driven. The timing controller 124 may convert the input image data to image data (e.g., display image data) by applying an algorithm for compensating display quality of the input image data and providing the image data to the data driver 130. Further, the timing controller 124 may generate a scan control signal and a data control signal that control driving timing of the image data based on the input control signal. The timing controller may provide the scan control signal to the scan driver 140 and may provide the data control signal to the data driver 130.

The timing controller 124 may be coupled to the facility driver 200 during the mechanism assembly process of the display panel 110. In some embodiments, the facility driver 200 may not include an additional pattern generator. The timing controller 124 may output align image data AIMG that includes an align pattern based on the align control signal ACTL provided from the facility driver 200. In some example embodiments, the align control signal ACTL may be a power signal, and the facility driver 200 may provide the power signal to the timing controller as the align control signal ACTL. The timing controller 124 may be driven in a fail mode when the power signal is provided to the timing controller 124. The timing controller 124 may output fail image data that displays an image (e.g., a predetermined image) on the display panel 110 in the fail mode. For example, the fail image data may be block image data that displays a black color image, red image data that displays a red color image, green image data that displays a green color image, and/or blue color image that displays a blue color image.

The timing controller 124 may detect the image data (e.g., the display image data). The timing controller 124 may output the align image data AIMG that includes the align pattern when the image data is the fail image data. The align image data AIMG may be image data in which the fail image data and the align pattern stored in the storage unit 122 are combined.

In other example embodiments, the align control signal ACTL may be an enable signal having a reference voltage level (e.g., a predetermined voltage level). The facility driver 200 may provide the enable signal having the reference voltage level to the timing controller 124. In some embodiments, the enable signal may activate a function that outputs the align image data AIMG from the timing controller 124 (e.g., may cause the timing controller 124 to output the align image data AIMG). The timing controller 124 may output the align image data AIMG in which the fail image data and the align pattern stored in the storage unit 122 are combined in response to the enable signal.

In other example embodiments, the align control signal ACTL may be a command signal. The facility driver 200 may provide the command signal to the timing controller 124 by using, for example, I2C communication. The command signal may be a signal that controls (e.g., that is configured to control) a logic block of the timing controller 124 (e.g., the timing controller 124 may be configured to control the logic block thereof in response to the command signal). The timing controller 124 may output the align image data AIMG in which the fail image data and the align pattern stored in the storage unit 122 are combined in response to the command signal.

The scan driver 140 may output a scan signal based on the scan control signal provided from the timing controller 124. The scan driver 140 may generate the scan signals SS to output (e.g., to display) the align image data AIMG during the mechanism assembly process of the display panel 110. The scan driver 140 may provide the scan signals SS to the pixels PX through the scan lines SL.

The data driver 130 may output a data signal DS based on the image data and the data control signal provided from the timing controller 124. The data driver 130 may generate the data signal DS corresponding to the align image data AIMG provided from the timing controller 124 during the mechanism assembly process of the display panel 110. The data driver 130 may provide the data signals DS to the pixels PX through the data lines DL.

As described above, the display device 100 according to example embodiments may simplify the mechanism assembly process of the display panel 110 by outputting the align image data AIMG based on the align control signal ACTL provided from the facility driver 200. Further, tack-times may be reduced because a facility change due to a product change is unnecessary. Further, a recognition rate of the align mark AM may be improved by displaying the align mark AM on the display panel 110 as the image. Further, the align mark AM may be positioned at correct positions because the facility driver 200 does not include a pattern generator and the image displayed on the display panel 110 corresponding to the align image data AIMG is generated in the timing controller 124.

Figure 3A:
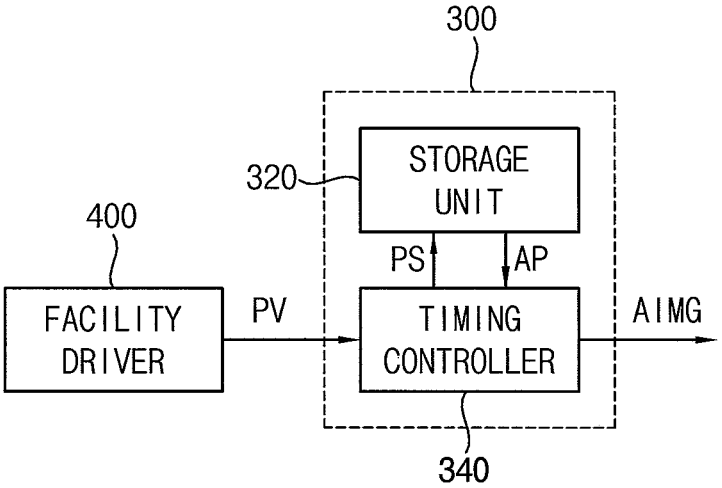
FIGS. 3A-3C are block diagrams illustrating examples of an operating method of a display panel driver included in the display device shown in FIG. 1.
Figure 3B:
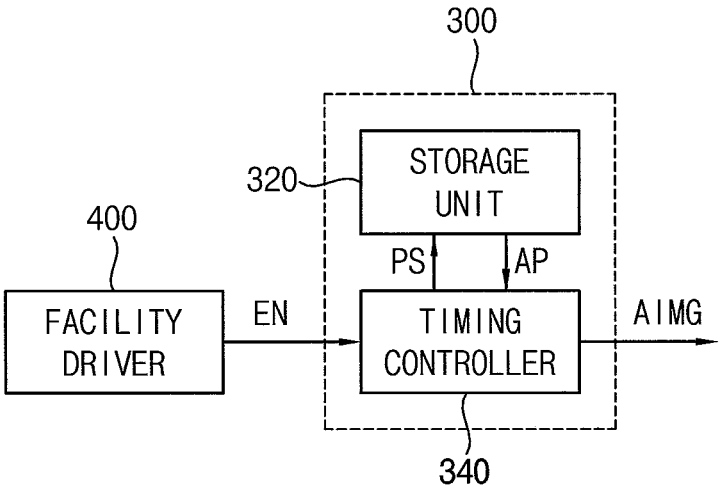
Figure 3C:
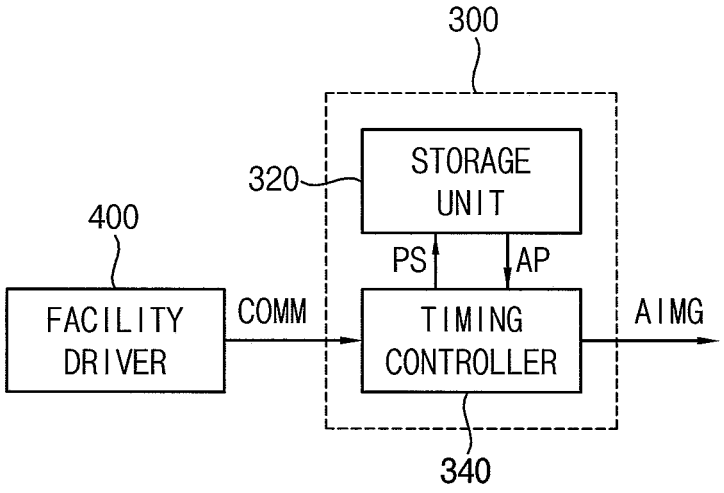

FIGS. 3A-3C are block diagrams illustrating examples of operation of a display panel driver included in the display device 100 shown in FIG. 1.

Referring to FIG. 3A, a display panel driver 300 may include a storage unit 320 and a timing controller 340. The storage unit 320 may store align patterns AP that include one or more align marks. The timing controller 340 may be coupled to the facility driver 400 during the mechanism assembly process of the display panel 110. The facility driver 400 may provide a power signal PV to the timing controller 340. The timing controller 340 may receive the input image data, the input control signal, the power signal PV, etc. when the display device 100 is driven. The timing controller 340 may be driven in the fail mode when abnormal input image data or an abnormal input control signal is provided thereto. The timing controller 340 may be driven in the fail mode when the input image data and the input control signal are not provided thereto and when only the power signal PV is provided. The timing controller 340 may output reference image data (e.g., predetermined image data) in the fail mode. The timing controller 340 according to example embodiments may output the fail image data that displays the reference image on the display panel in the fail mode. The timing controller 340 may detect the image data input to the timing controller and may provide a pattern control signal PS to the storage unit 320 when the image data is the fail image data. The storage unit 320 may provide one of the align patterns AP to the timing controller 340 based on the pattern control signal PS. The timing controller 340 may generate the align image data AIMG in which the fail image data and the align pattern AP stored in the storage unit 320 are combined and may provide the align image data AIMG to the data driver 130.

Referring to FIG. 3B, the display panel driver 300 may include the storage unit 320 and the timing controller 340. The storage unit 320 may store the align patterns AP that include one or more align marks. The timing controller 340 may be coupled to the facility driver 400 during the mechanism assembly process of the display panel. The facility driver 400 may provide an enable signal EN to the timing controller 340. The enable signal EN may have a reference voltage level (e.g., a predetermined voltage level). The enable signal EN may be a signal that activates a function in the timing controller 340 to output the align image data AIMG. The timing controller 340 may generate the fail image data in response to the enable signal EN and may provide the pattern control signal PS to the storage unit 320. The storage unit 320 may provide one of the align patterns AP based on the pattern control signal PS. The timing controller 340 may generate the align image data AIMG in which the fail image data and the align pattern AP provided from the storage unit 320 are combined and may output the align image data AIMG to the data driver 130.

Referring to FIG. 3C, the display panel driver 300 may include the storage unit 320 and the timing controller 340. The storage unit 320 may store the align patterns AP that include one or more align marks. The timing controller 340 may be coupled to the facility driver 400 during the mechanism assembly process of the display panel. The facility driver 400 may provide a command signal COMM to the timing controller 340. The command signal COMM may be a signal that controls a logic block of the timing controller 340. The timing controller 340 may generate the fail image data in response to the command signal COMM and may provide the pattern control signal PS to the storage unit 320. The storage unit 320 may provide one of the align patterns AP to the timing controller 340 based on the pattern control signal PS. The timing controller 340 may generate the align image data AIMG in which the fail image data and the align pattern AP provided by the storage unit 320 are combined and may output the align image data AIMG to the data driver.

Figure 4A:
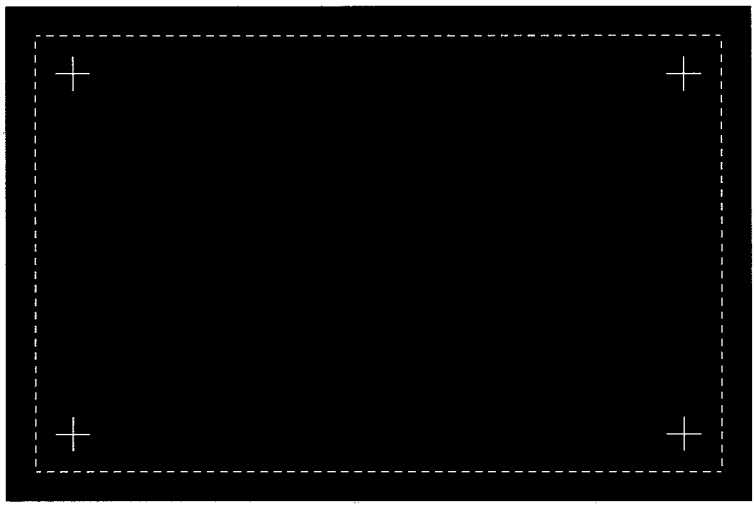
FIGS. 4A-4C are diagrams illustrating examples of align image data output from a display panel driver included in the display device shown in FIG. 1.
Figure 4B:
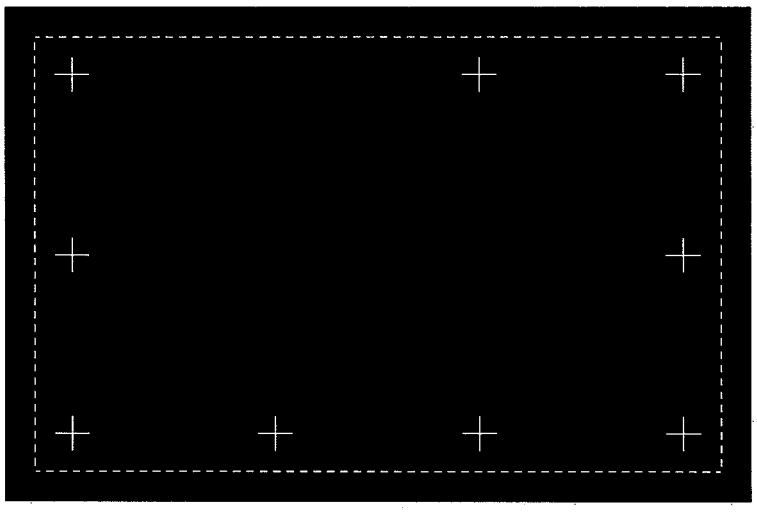
Figure 4C:
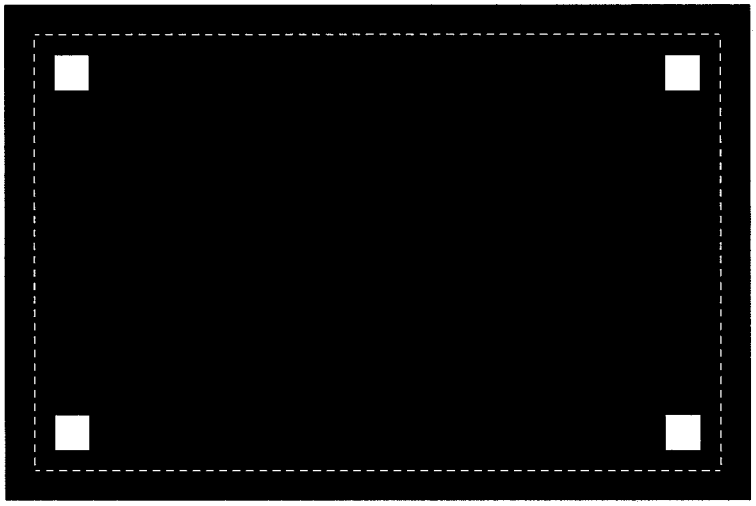

FIGS. 4A-4C are diagrams illustrating examples of align image data output from a display panel driver included in the display device 100 shown in FIG. 1.

Referring to FIGS. 4A-4C, the display panel driver may output the align image data in which the black image data and the align pattern are combined during the mechanism assembly process of the display panel. The timing controller included in the display panel driver may generate the black image data in response to one of the power signal PV, the enable signal EN, and the command signal COMM provided from the facility driver. Further, the timing controller may provide the pattern control signal PS to the storage unit included in the display panel driver and may receive one of the align patterns AP from the storage unit.

Referring to FIG. 4A, the timing controller may generate the align image data by combining the black image data and the align pattern that includes the plus- or cross-shaped align marks positioned at four corners of the display area of the display panel.

Referring to FIG. 4B, the timing controller may generate the align image data by combining the black image data and the align pattern that includes the plus- or cross-shaped align marks arranged at regular intervals around the display area of the display panel.

Referring to FIG. 4C, the timing controller may generate the align image data by combining the black image data and the align pattern that includes the square-shaped align marks positioned at four corners of the display area of the display panel.

Although the align image data in which the black image data and the align pattern are combined is described with respect to FIGS. 4A-4C, the image data combined with the align pattern is not limited to black image data. The image data combined with the align pattern may have a color that improves visibility of the align pattern. For example, the timing controller may generate the align image data in which gray image data and the align pattern are combined. Further, the align mark(s) included in the align pattern may have various colors and various shapes and may be present in various numbers.

Figure 5A:
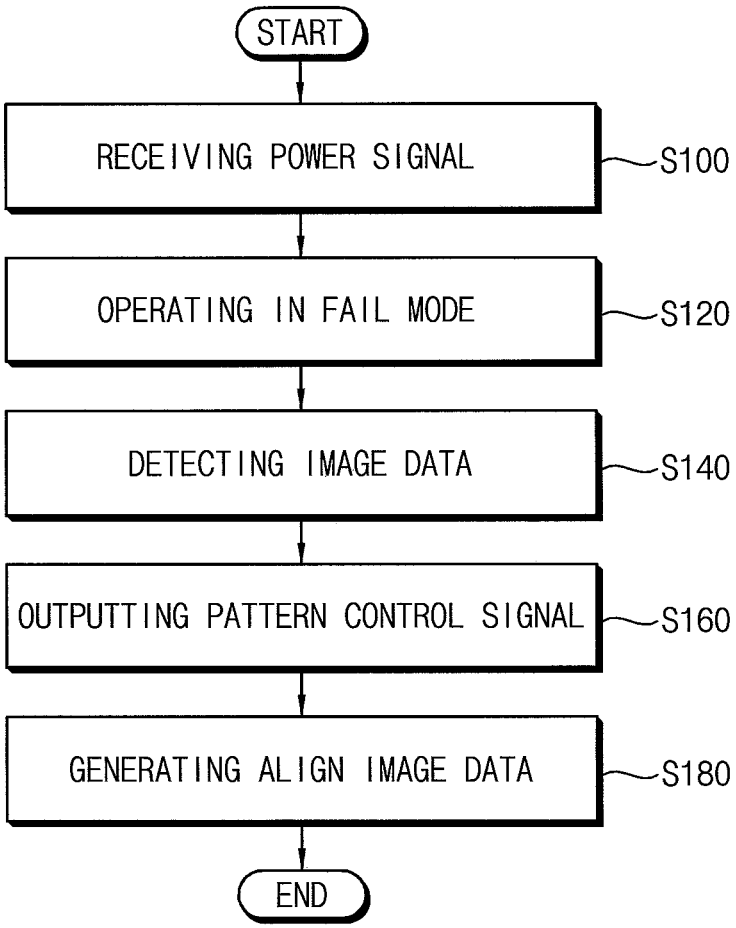
FIGS. 5A-5C are flowcharts illustrating examples of a driving method of the display device shown in FIG. 1 during a mechanism assembly process of the display panel.
Figure 5B:
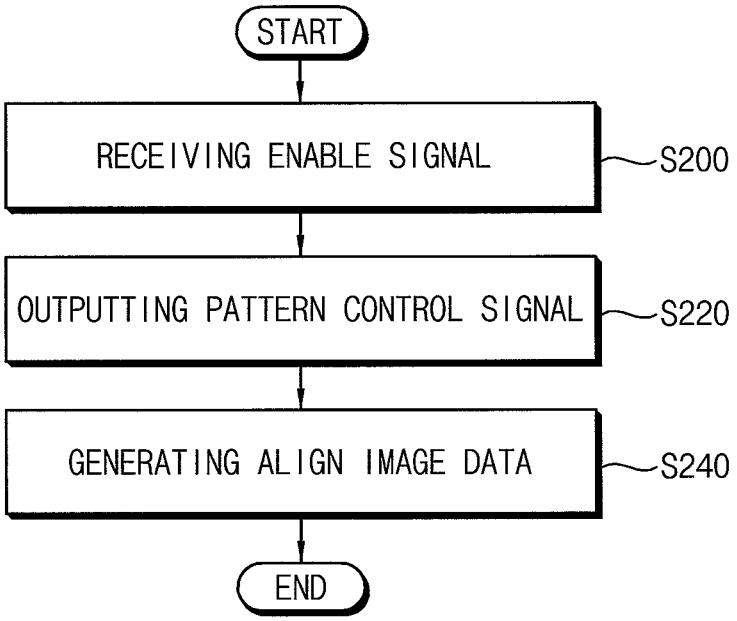
Figure 5C:
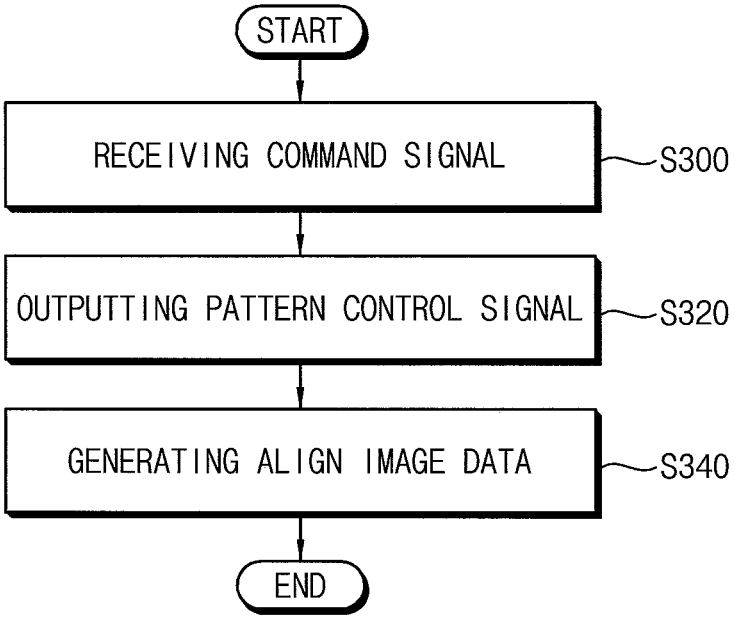

FIGS. 5A-5C are flowcharts illustrating examples of a driving method of the display device shown in FIG. 1 during a mechanism assembly process of the display panel.

A driving method of the display device during the mechanism assembly process of the display panel may include receiving a power signal S100, operating in the fail mode S120, detecting the image data S140, outputting the pattern control signal S160, and generating and outputting the align image data S180.

The driving method of the display device during the mechanism assembly process of the display panel may include receiving the power signal from the facility driver S100. The facility driver may not include an additional pattern generator and may provide the power signal to the display panel driver.

The driving method of the display device during the mechanism assembly process of the display panel may include operating the display panel (e.g., the timing controller) in the fail mode S120. When only the power signal is provided to the timing controller of the display panel driver, the timing controller may operate in the fail mode. The timing controller may output reference image data (e.g., predetermined image data) in the fail mode. For example, the timing controller may output the fail image data that displays the reference image on the display panel in the fail mode.

The driving method of the display device during the mechanism assembly process of the display panel may include detecting the fail image data (e.g., the black image data) output to the data driver in the fail mode S140. For example, the timing controller of the display panel driver may analyze the red image data, the green image data, and the blue image data of the image data output to the data driver and may determine whether or not the image data is the fail image data.

The driving method of the display device during the mechanism assembly process of the display panel may include outputting the pattern control signal to the storage unit of the display panel when the image data output to the data driver is the fail image data S160. The storage unit of the display panel driver may store the plurality of align patterns, and the storage unit may output one of the align patterns based on the pattern control signal.

The driving method of the display device during the mechanism assembly process of the display panel may include generating the align image data S180. The timing controller of the display panel driver may generate the align image data by combining the fail image data and the align pattern, and the timing controller may output the align image data to the data driver.

As described above, the driving method of the display device during the mechanism assembly process of the display panel may include displaying the align mark without a pattern generator by storing the align patterns, detecting the image data of the timing controller operated in the fail mode based on the power signal provided from the facility driver, and generating the align image data based on the image data and the align pattern. Further, the driving method of the display device during the mechanism assembly process of the display panel may include displaying an align mark suitable for each display panel without changing of the facility by outputting the align pattern stored in the display panel driver of each of the display panels.

Referring to FIG. 5B, the driving method of the display device during the mechanism assembly process of the display panel may include receiving the enable signal S200, outputting the pattern control signal S220, and outputting the align image data S240.

The driving method of the display device during the mechanism assembly process of the display panel may include receiving the enable signal form the facility driver S200. The facility driver may not include an additional pattern generator and may provide the enable signal to the display panel driver. The enable signal may have a reference voltage level (e.g., a predetermined voltage level). The enable signal may activate the function that outputs the align image data from the timing controller.

The driving method of the display device during the mechanism assembly process of the display panel may output the pattern control signal to the storage unit of the display panel driver in response to the enable signal provided from the facility driver S220. The storage unit of the display panel driver may include the plurality of align patterns. The storage unit of the display panel driver may output one of the align patterns based on the pattern control signal.

The driving method of the display device during the mechanism assembly process of the display panel may include generating the align image data S240. The timing controller of the display panel driver may generate the align image data by combining the fail image data and the align pattern. The timing controller of the display panel driver may output the align image data to the data driver.

As described above, the driving method of the display device during the mechanism assembly process of the display panel may include displaying the align mark on the display panel without (e.g., without using) a pattern generator by storing the align patterns and generating the align image data based on the enable signal provided by the facility driver. Further, the driving method of the display device during the mechanism assembly process of the display panel may include displaying the align mark suitable for each of the display panels without changing the facility by outputting the align pattern stored in the display panel driver of each of the display panels.

Referring to FIG. 5C, a driving method of the display device during the mechanism assembly process of the display panel may include receiving the command signal S300, outputting the pattern control signal S320, and outputting the image data S340.

The driving method of the display device during the mechanism assembly process of the display panel may include receiving the command signal S300 from the facility driver. The facility driver may not include an additional pattern generator and may provide the command signal to the display panel driver. The command signal may be a signal that controls the logic block of the timing controller.

The driving method of the display device during the mechanism assembly process of the display panel may include outputting the pattern control signal to the storage unit of the display panel driver in response to the command signal provided from the facility driver S320. The storage unit of the display panel driver may include a plurality of align patterns, and the storage unit of the display panel driver may output one of the align patterns based on the pattern control signal.

The driving method of the display device during the mechanism assembly process of the display panel may include generating the align image data S340. The timing controller of the display panel driver may generate the align image data by combining the fail image data and the align pattern. The timing controller of the display panel driver may output the align image data to the data driver.

As described above, the driving method of the display device during the mechanism assembly process of the display panel may include displaying the align mark on the display panel without (e.g., without using) a pattern generator by storing the align patterns and generating the align image data based on the command signal provided by the facility driver. Further, the driving method of the display device during the mechanism assembly process of the display panel may include displaying the align mark suitable for each of the display panels without changing the facility by outputting the align pattern stored in the display panel driver of each of the display panels.

The present inventive concept may be applied to a display device and an electronic device including the display device. For example, the present inventive concept may be applied to a computer monitor, a laptop, a digital camera, a cellular phone, a smart phone, a smart pad, a television, a personal digital assistant (PDA), a portable multimedia player (PMP), an MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the aspects and features of the present inventive concept. Accordingly, all such modifications are intended to be included within the scope of the present inventive concept as defined in the claims and their equivalents. Therefore, it is to be understood that the foregoing is illustrative of various example embodiments and the present inventive concept is not to be construed as being limited to the example embodiments disclosed. Further, modifications to the disclosed example embodiments, as well as other example embodiments, are intended to be included within the scope of the appended claims and their equivalents.

What is claimed is:

1. A display panel driver comprising:

a storage unit configured to store an align pattern, the align pattern comprising an align mark; and a timing controller configured to output align image data based on an align control signal provided from a facility driver during a mechanism assembly process of a display panel, the align image data comprising the align pattern, wherein the align control signal is a power signal, an enable signal having a reference voltage level, or a command signal provided to the timing controller by using I2C communication.

2. The display panel driver of claim 1, wherein the timing controller is configured to be driven in a fail mode when the power signal is provided to the timing controller.

3. The display panel driver of claim 2, wherein the timing controller is configured to output fail image data in the fail mode, and wherein the display panel is configured to display an image based on the fail image data.

4. The display panel driver of claim 3, wherein the timing controller is configured to detect image data output from the timing controller and is configured to output the align image data when the image data is the fail image data.

5. The display panel driver of claim 1, wherein the timing controller is configured to output the align image data when the enable signal is provided to the timing controller.

6. The display panel driver of claim 1, wherein the timing controller is configured to output the align image data when the command signal is provided to the timing controller.

7. A display device comprising:

a display panel configured to display an image; and a display panel driver configured to provide image data to the display panel, wherein the display panel driver is configured to be coupled to a facility driver during a mechanism assembly process of the display panel and is configured to output align image data comprising an align pattern based on an align control signal provided from the facility driver, wherein the display panel driver comprises:

a storage unit configured to store the align pattern, the align pattern comprising an align mark; and a timing controller configured to output the align image data based on the align control signal provided from the facility driver during the mechanism assembly process of the display panel, and wherein the align control signal is a power signal, an enable signal having a reference voltage level, or a command signal provided to the timing controller by using I2C communication.

8. The display device of claim 7, wherein the timing controller is configured to be driven in a fail mode when the power signal is provided to the timing controller.

9. The display device of claim 8, wherein the timing controller is configured to output fail image data that displays an image on the display panel.

10. The display device of claim 9, wherein the timing controller is configured to detect image data output from the timing controller and is configured to output the align image data when the image data is the fail image data.

11. The display device of claim 7, wherein the timing controller outputs the align image data when the enable signal is provided to the timing controller.

12. The display device of claim 7, wherein the timing controller is configured to output the align image data when the command signal is provided to the timing controller.

13. The display device of claim 7, wherein the align pattern comprises the align mark arranged on at a reference position.

* * * * *